US007070901B2

(12) United States Patent
Kabai

(10) Patent No.: US 7,070,901 B2
(45) Date of Patent: Jul. 4, 2006

(54) DEVELOPING AGENT AND IMAGE FORMING APPARATUS

(75) Inventor: Takahito Kabai, Mishima (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/059,456

(22) Filed: Feb. 16, 2005

(65) Prior Publication Data

US 2005/0147910 A1 Jul. 7, 2005

Related U.S. Application Data

(63) Continuation of application No. 10/339,598, filed on Jan. 10, 2003, now Pat. No. 6,861,194.

(51) Int. Cl.
*G03G 15/20* (2006.01)

(52) U.S. Cl. ..... 430/124; 430/110.1; 430/109.4; 399/333

(58) Field of Classification Search ..... 430/124, 430/110.1, 109.4; 399/333
See application file for complete search history.

(56) References Cited

U.S. PATENT DOCUMENTS 6,625,418 B1 9/2003 Kabai et al.
6,861,194 B1 * 3/2005 Kabai ..... 430/124

FOREIGN PATENT DOCUMENTS

| | | | |
|---|---|---|---|
| EP | 1 003 081 | A1 | 5/2000 |
| JP | 2000-155443 | A | 6/2000 |
| JP | 2001-175104 | A | 6/2001 |
| JP | 2001-312169 | A | 11/2001 |

* cited by examiner

*Primary Examiner*—Mark A. Chapman
(74) *Attorney, Agent, or Firm*—Foley & Lardner LLP

(57) ABSTRACT

The softening point of the binder resin and the thickness of the rubber layer of the fixing roller are optimized and thus it becomes possible to form a high-quality full-color image at a low cost.

15 Claims, 1 Drawing Sheet

DEVELOPING AGENT AND IMAGE FORMING APPARATUS

The present application is a continuation of U.S. application Ser. No. 10/339,598, filed Jan. 10, 2003, now U.S. Pat. No. 6,861,194 the entire contents of which are incorporated herein by reference.

BACKGROUND OF THE INVENTION

The present invention relates to an image fixing method and developing agent, which can be applied to image formation by, for example, electrostatic recording apparatus and electrophotographic apparatus.

It is conventionally known, as discussed in, for example, Jpn. Pat. Appln. KOKAI Publication No. 2001-312169 that the fixation of a full-color image can be carried out at a low cost by combining a fixing roller having a surface Layer made of a fluorine-containing resin such as ethylene tetrafluoride perfluoroether copolymer (PFA) and a wax-containing full-color toner.

Further, from the viewpoint of saving energy, the heat capacity of the fixing unit is reduced, and thus the time for warming up is shortened. This is also effective for reducing the cost. In order to reduce the heat capacity of the fixing unit, it is known to be effective that no rubber layer is used for the fixing roller, or the rubber layer is made thin.

It should be noted that when the rubber layer is thick, uniform fusion and uniform pressurization can be carried out, whereas when the layer is thin, there is a tendency that that the fusion and pressurization become uneven. While there is a demand of improving the quality of full-color images, if the fusion and pressurization are excessively carried out in a heat-pressure fixing step, dots are smashed. Thus, a touch of grittiness is caused on the image, making it impossible to obtain an excellent image. On the other hand, when the fusion and pressurization are uneven, irregular gloss is created in the solid image, thereby making the image quality uneven.

Additionally, in general, there is a strong demand of making a high gloss image in terms of a high-quality appearance of the color image and color reproducibility; however in some cases, matte-tone and glossless images are preferred for office use. To create a matte-tone image, the softening point of the toner can be high (about 145° C.), but it is very difficult to set conditions for fixing even such toner that has such a high softening point.

As described above, it is conventionally very difficult to optimize the thickness of the rubber layer of the fixing roller because the energy saving conditions, grittiness and evenness of the quality over the solid image conflict with each other.

BRIEF SUMMARY OF THE INVENTION

The present invention has been proposed in consideration of the above-described circumstances, and the first object thereof is to provide a developing agent that can optimize its property in accordance with a fixing roller employed, thereby making it possible to an excellent image at a low cost.

The second object of the present invention is to provide a fixation method by which an excellent image can be formed at a low cost, by optimizing the properties of the employed fixing roller and the developing agent.

According to the first aspect of the present invention, there is provided a developing agent that is used in combination with a fixing device comprising a thermal fixing roller including a metal roller, a rubber layer provided on a surface of the metal roller and having a rubber hardness defined by JIS A of 3° or more and less than 5°, and a fluorine-containing resin coating layer provided on the rubber layer, and a press roller provided to face the thermal fixing roller, wherein the developing agent contains a coloring agent and a binder resin, a softening point of the binder resin and a thickness of the rubber layer satisfying a relationship represented by the following formula, as well as a fixing method using these:

$$y \geqq 10^{-6}x^4 - 0.0007x^3 + 0.1217x^2 - 9.932x + 314.31 \quad (1)$$

where y: the thickness of the rubber layer (mm)

x: the softening point (° C.) of the binder resin.

According to the second aspect of the present invention, there is provided a developing agent that is used in combination with a fixing device comprising a thermal fixing roller including a metal roller, a rubber layer provided on a surface of the metal roller and having a rubber hardness defined by JIS A of 3° or more and less than 8°, and a fluorine-containing resin coating layer provided on the rubber layer, and a press roller provided to face the thermal fixing roller, wherein the developing agent contains a coloring agent and a binder resin, a softening point of the binder resin and a thickness of the rubber layer satisfying a relationship represented by the following formula, as well as a fixing method using these:

$$y \geqq 10^{-6}x^4 - 0.0004x^3 + 0.0774x^2 - 6.2789x + 200.34 \quad (2)$$

where y: the thickness of the rubber layer (mm)

x: the softening point (° C.) of the binder resin.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
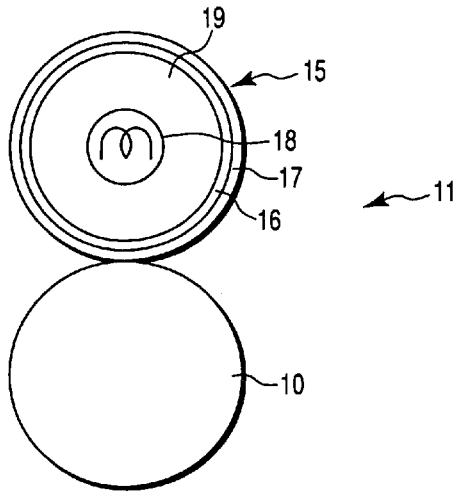
FIG. 1 is a cross sectional view of an example of the fixing device used in the present invention.

FIG. 1 is a cross sectional view of an example of the fixing device used in the present invention.

As shown in this figure, a fixing device includes a thermal fixing roller 15 and a press roller 10. The thermal fixing roller 15 has a structure in which a heating mechanism 18 such as a heater lamp of, for example, 550 W, is built in a cored metal 19 of an iron pipe having a diameter of 30 mm and a thickness of 2 mm, for example, and a rubber layer 16 and a fluorine-resin containing layer 17 made of, for example, PFA, are laminated on an outer circumferential surface of the cored metal in the order. An electromagnetic induction type heating coil can be used as the heating mechanism 18. The press roller 10 is placed to face the thermal fixing roller 15, and the roller includes a cored metal made of an aluminum pipe having an outer diameter of 40 mm, ASKER-C hardness of 80° and a thickness of 5 mm, for example, a rubber layer of silicone, for example, having a thickness of, for example, 1 mm, formed as a coating on an outer circumferential surface of the cored metal, and a PFA layer having a thickness of, for example, 30 μm, formed as a coating on an outer circumferential surface of the rubber layer. The press roller 10 is pressed against the thermal fixing roller 15 at a predetermined load pressure of about 250 N by means of a pressing mechanism such as a spring, which is not shown, such as to be able to have a nip width of, for example, 7.5 mm between these rollers 10 and 15.

In a fixing device 11, fixing is performed at a fixing temperature of, for example, 150 to 180° C. by means of the heat roller 15 and the press roller 10. The fixing device 11 employed here has a structure similar to that shown in FIG. 1. Note that the fixing device 11 is an oilless fixing device, which does not have an oil supply mechanism.

The present invention will now be described in detail by presenting embodiments thereof.

EMBODIMENT 1

Color toner materials listed in TABLES 1-1 to 1-4 were prepared. Each of the materials was kneaded with a 2-axial continuous kneader and then dried. After that, the material was processed with a collision-type crusher and an airflow classifier in this order, and thus toner particles having a size of 8 μm were obtained. Thus obtained toner particles were mixed with 1.0% of silica (R972, a product of Nippon Aerogil) using a Henschel mixer (of Mitsui Mining Co., Ltd.), and thus yellow (Y), magenta (M), cyan (C) and black (K) toners were obtained.

TABLE 1-1

Composition of yellow toner

| | | Amount of addition |
|---|---|---|
| Binder resin | Polyester resin (Tm = 110° C.) | 92% |
| Pigment | Yellow pigment (Pig.Y.180) | 4% |
| Wax | Rice wax | 3% |
| CCA | Zirconia complex | 1% |

TABLE 1-2

Composition of Magenta toner

| | | Amount of addition |
|---|---|---|
| Binder resin | Polyester resin (Tm = 110° C.) | 90% |
| Pigment | Yellow pigment (Pig.R.122) | 6% |

TABLE 1-2-continued

Composition of Magenta toner

| | | Amount of addition |
|---|---|---|
| Wax | Rice wax | 3% |
| CCA | Zirconia complex | 1% |

TABLE 1-3

Composition of cyan toner

| | | Amount of addition |
|---|---|---|
| Binder resin | Polyester resin (Tm = 110° C.) | 92% |
| Pigment | Yellow pigment (Pig.B.15-3) | 4% |
| Wax | Rice wax | 3% |
| CCA | Zirconia complex | 1% |

TABLE 1-4

Composition of black toner

| | | Amount of addition |
|---|---|---|
| Binder resin | Polyester resin (Tm = 110° C.) | 92% |
| Pigment | Yellow pigment (black pigment) | 4% |
| Wax | Rice wax | 3% |
| CCA | Zirconia complex | 1% |

Note that in TABLEs, Tm indicates a softening point.

The softening point of the binder resin was measured by a flow tester (of Shimadzu Corporation). The term, softening point used here is defined as follows. That is, a sample was put in a heat cylinder and while heating the cylinder, it was pressurized with a plunger. Then, a flow test was carried out under conditions indicated in TABLE 2 below with use of the flow tester of Shimadzu Corporation, and the temperature measured when the plunger moved down for 2 mm was taken as the softening point.

TABLE 2

Measurement conditions of flow tester

| Items | Set conditions |
|---|---|
| RATE TEMP | 6.000° C./minutes |
| SET TEMP | 40.00° C. |
| MAX TEMP | 150.0° C. |
| INTERNAL | 3.000° C. |
| PREHEAT | 300.0 seconds |
| POS. MIN | 1.000 mm |
| POS. MAX | 15.00 mm |
| LOAD | 20.00 kg |
| DIE (DIA) | 1.000 mm |
| DIE (LENG) | 1.000 mm |
| K. FACTOR | 1.000 |
| PLUNGER | 1.000 cm2 |

With regard to the case where the JIS A hardness of the fixing roller is 4°, the thickness (y) of the rubber layer and the softening point (x) of the binder resin were varied, and as the image qualities, the grittiness and evenness over the solid image were evaluated for the varied conditions. The results of the comparison were summarized in TABLE 3.

Note that in the table, symbol ○/○ indicates a good evaluation in the grittiness/a good evaluation in the evenness over the solid image, symbol x/○ indicates a no-good evaluation in the grittiness/a good evaluation in the evenness over the solid image, symbol ○/x indicates a good evaluation in the grittiness/a no-good evaluation in the evenness over the solid image, and symbol x/x indicates a no-good evaluation in the grittiness/a no-good evaluation in the evenness over the solid image.

The evaluation of the grittiness was made as follows. That is, with use of a full-color copy machine of TOSHIBA TEC, "Fantasia 22j", a photographic image of a person in a scene was output for each case and it was evaluated by visual inspection.

On the other hand, the evenness over the solid image was evaluated as follows. That is, with use of Fantasia P221, an image of an even single color was output for each case and it was evaluated by visual inspection.

TABLE 3

| y | x (° C.) | | | | | | | | | | |
|---|---|---|---|---|---|---|---|---|---|---|---|
| (mm) | 100 | 105 | 110 | 115 | 120 | 125 | 130 | 135 | 140 | 145 | 150 |
| 2.0 | ○/○ | ○/○ | ○/○ | ○/○ | ○/○ | ○/○ | ○/○ | ○/○ | ○/○ | ○/○ | ○/○ |
| 1.5 | x/○ | ○/○ | ○/○ | ○/○ | ○/○ | ○/○ | ○/○ | ○/○ | ○/○ | ○/○ | ○/○ |
| 1.0 | x/○ | x/○ | ○/○ | ○/○ | ○/○ | ○/○ | ○/○ | ○/○ | ○/○ | ○/○ | ○/x |
| 0.5 | x/○ | x/○ | x/○ | ○/○ | ○/○ | ○/○ | ○/○ | ○/○ | ○/○ | ○/○ | ○/x |
| 0.3 | x/○ | x/○ | x/○ | x/○ | ○/○ | ○/○ | ○/○ | ○/○ | ○/○ | ○/x | ○/x |
| 0.2 | x/○ | x/○ | x/○ | x/○ | ○/○ | ○/○ | ○/○ | ○/○ | ○/○ | ○/x | ○/x |
| 0.1 | x/○ | x/○ | x/○ | x/○ | x/○ | ○/○ | ○/○ | ○/○ | ○/x | ○/x | ○/x |
| 0.0 | x/x | x/x | x/x | x/x | x/x | x/x | x/x | x/x | x/x | x/x | x/x |

Figure 2:
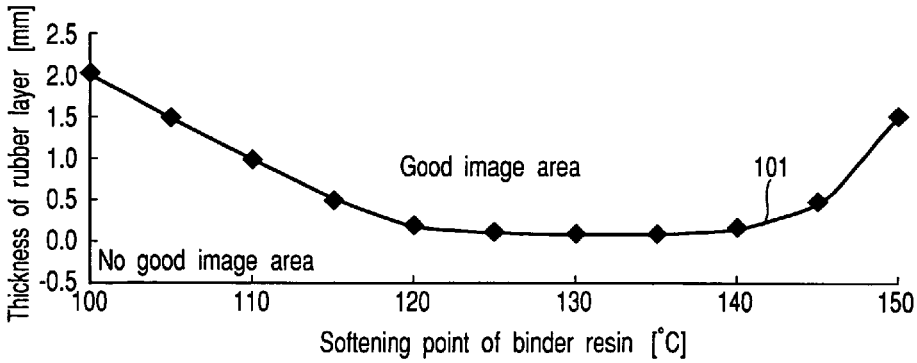
FIG. 2 is a graph indicating the correlations between the image quality, the thickness of the rubber layer and the softening point of the binder resin for a constant rubber hardness.

The area where the image quality is indicated to be good in TABLE 3 is shown in FIG. 2.

In FIG. 2, a curve 101 is expressed by an equation: $y \geqq 10^{-6}x^4-0.0007x^3+0.1217x^2-9.9932x+314.31$ in the graph.

As illustrated in the figure, in the case where the JIS A hardness of the fixing roller is 4°, a high quality image could be obtained in the region represented by the following formula 1:

$$y \geqq 10^{-6}x^4-0.0007x^3+0.1217x^2-9.9932x+314.31 \quad (1)$$

where y: the thickness (mm) of the rubber layer having a JIS A rubber hardness of 3° or more and less than 5°, and x: the softening point (° C.) of the binder resin.

Next, with regard to the case where the JIS A hardness of the fixing roller is 8°, the values y and x were varied, and the grittiness and evenness over the solid image were evaluated for the varied conditions. The results of the comparison were summarized in TABLE 4.

TABLE 4

| y | x (° C.) | | | | | | | | | | |
|---|---|---|---|---|---|---|---|---|---|---|---|
| (mm) | 100 | 105 | 110 | 115 | 120 | 125 | 130 | 135 | 140 | 145 | 150 |
| 2.0 | x/○ | ○/○ | ○/○ | ○/○ | ○/○ | ○/○ | ○/○ | ○/○ | ○/○ | ○/○ | ○/○ |
| 1.5 | x/○ | x/○ | ○/○ | ○/○ | ○/○ | ○/○ | ○/○ | ○/○ | ○/○ | ○/○ | ○/○ |
| 1.0 | x/○ | x/○ | x/○ | ○/○ | ○/○ | ○/○ | ○/○ | ○/○ | ○/○ | ○/○ | x/○ |
| 0.5 | x/○ | x/○ | x/○ | x/○ | ○/○ | ○/○ | ○/○ | ○/○ | ○/○ | ○/○ | x/○ |
| 0.3 | x/○ | x/○ | x/○ | x/○ | x/○ | ○/○ | ○/○ | ○/○ | ○/○ | x/○ | ○/x |
| 0.2 | x/○ | x/○ | x/○ | x/○ | x/○ | ○/○ | ○/○ | ○/○ | x/○ | ○/x | ○/x |
| 0.1 | x/○ | x/○ | x/○ | x/○ | x/○ | x/○ | ○/○ | ○/○ | ○/x | ○/x | ○/x |
| 0.0 | x/x | x/x | x/x | x/x | x/x | x/x | x/x | x/x | x/x | x/x | x/x |

Figure 3:
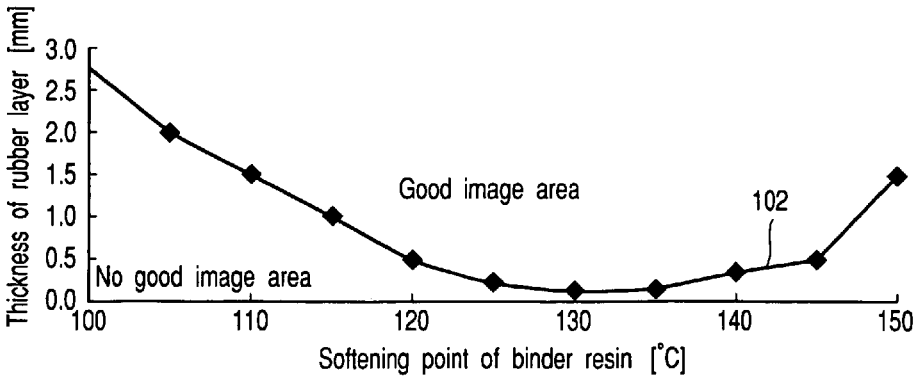
FIG. 3 is a graph indicating the correlations between the image quality, the thickness of the rubber layer and the softening point of the binder resin for another constant rubber hardness.

The area where the image quality is indicated to be good in TABLE 4 is shown in FIG. 3.

In FIG. 3, a curve 102 is expressed by an equation: $y \geqq 10^{-6}x^4-0.0004x^3+0.0774x^2-6.2789x+200.34$ in the graph.

As illustrated in the figure, in the case where the JIS A hardness of the fixing roller is 8°, a high quality image could be obtained in the region represented by the following formula 1:

$$y \geqq 10^{-6}x^4-0.0004x^3+0.0774x^2-6.2789x+200.34 \quad (2)$$

where y: the thickness (mm) of the rubber layer having a JIS A rubber hardness of 5° or more and less than 8°, and x: the softening point (° C.) of the binder resin.

As can be understood from TABLES 3 and 4 as well as FIGS. 2 and 3, if there was no rubber layer provided (y=0), unevenness was created over the solid images and excellent images were not obtained regardless of the type of binder resin used. This is considered as follows. As an entire image obtained after development, uneven gloss was created due to various thicknesses of toner layers, which slightly differ from one to another. More specifically, because of the unevenness of the toner layer thickness, the pressure could not be applied evenly in the case where a roller without a rubber layer, that had a rigid surface on the fixing roller, was employed. Similarly, it has been also found that in the case where a toner having a high softening point (x) is used, uneven gloss is creased due to uneven press unless the rubber layer is made to have a sufficient thickness.

As can be understood from TABLES 3 and 4 as well as FIGS. 2 and 3, if there was no rubber layer provided (y=0), grittiness in half tone was created in the images and excellent images were not obtained regardless of the type of binder resin used. This is considered as follows. With use of a roller without a rubber layer, that had a rigid surface on the fixing roller, dots are crushed. Therefore, the dot size of the image becomes uneven, which results in a gritty image. Similarly, it has been also found that in the case where a toner having a low softening point (x) is used, grittiness in half tome was created in the images due to crushed dots unless the rubber layer is made to have a sufficient thickness.

Thus, it has been found an image with both an evenness over the image and a quality in terms of half-tone grittiness being achieved at the same time can be obtained by satisfying the conditions expressed by the above equation.

The degree of gloss of an image varies depending on the type of binder used; however with use of the present invention, it is possible to select an appropriate resin in accordance with a desired image. Therefore, an optimal thickness of the rubber layer can be selected in accordance with the softening point of the resin employed. In this manner, it is not longer necessary to employ an excessively thick rubber layer.

From the viewpoint of achieving a high-quality appearance of the color image and color reproducibility, there is a demand for a copy image having a high gloss degree. In order to obtain an image of a high gloss degree, it is necessary to use a toner that can be easily fused. A sufficiently gloss can be obtained if the softening point is 115° C. or less. In the meantime, as an office-use case, matte-tone and glossless images are preferred, and therefore it is desired to use a toner that cannot be easily fused. In this case, usually, with a softening point of about 145° C., a perfect matte image that is the same as those produced by the conventional monochrome copy apparatus can be obtained.

According to the present invention, even in the case where a binder having a softening point in a range of 115° C. to 145° C. is used, it is possible to handle various requirements for the developing agent simply by changing the thickness of the rubber layer of the heat fixing roller. Further, from the viewpoint of reducing the heat capacity, it is desirable that the thickness of the rubber can be decreased within a range that satisfies the above-indicated relationship. Thus, preferably, the thickness of the rubber layer can be made 1.0 mm or less, and in this manner, images of various usages, that is, from a high gloss image to matte-tone image, can be covered while being able to reduce the heat capacity. When it is 0.5 mm or less, relatively matte-tone images are formed, making it possible to further reduce the heat capacity.

In the case where the thickness of the rubber layer is 1.5 mm or more, it is possible to reproduce an image of high gloss to matte-tone. However, from the point of decreasing the thermal capacity of the fixing device, the rubber layer is inferior to that has a thickness of 1.0 mm or less. Therefore, it is preferable that the thickness of the rubber layer can be 1.0 mm or less.

Thus, it is preferable that the thickness of the rubber can be 0.1 to 1.0 mm or less, and more preferably, it can be 0.2 to 0.8 mm. If the thickness is less than 0.1 mm, there is a tendency that it becomes difficult to form the rubber layer uniformly, whereas if it exceeds 1.0 mm, there is a tendency that it becomes difficult to decrease the thermal capacity of the fixing roller.

In the case where the softening point of the binder resin is set to 150° C., it is desirable to set the thickness of the rubber layer to 1.5 mm or more in order to achieve a high-quality image. Here, from the point of decreasing the thermal capacity of the fixing device, it is inferior to the type having a binder resin softening point of 145° C. or less. With regard to the gloss of the image, no particular difference is observed as compared to the case where the softening point is 145° C., and therefore there is no particular effect for selecting a softening point of 150° C. Therefore, it is preferable that the softening point of the binder resin can be 145° C. or less.

According to the present invention, in accordance with the rubber hardness of the rubber layer employed in the fixing device, the thickness of the rubber layer and the softening point of the binder resin are adjusted to satisfy the above formula (1) or (2). With this adjustment, it becomes possible to reduce the thickness of the rubber layer provided in the fixing roller to make it as thin as possible while maintaining evenness of fusion of the developing agent and evenness of the pressure. In this manner, the heat capacity of the fixing device can be reduced, and the warming-up time can be shortened. Thus, the operation cost can be significantly reduced without deteriorating the image quality.

In particular, when the thickness of the rubber layer is 1.0 mm or less, the softening point can be selected from a range of 120 to 140° C. Further, when the thickness of the rubber layer is as thin as 0.5 mm or less, images with an excellent matte-tone can be obtained by setting the softening point to 125 to 135° C.

From the viewpoint of achieving a soft fixing technique, the rubber hardness of the rubber layer employed in the present invention can be low as possible, and if the rubber hardness defined by JIS A exceeds 8°, the crush of dots easily occurs due to the pressure. If the rubber hardness defined of JIS A is less than 3°, permanent distortion can be easily created. Therefore, the rubber hardness defined by JIS A in the present invention is set to be 3 to 8°.

An example of the material used for the rubber layer is silicone rubber.

Preferable examples of the binder resin are a polyester resin, a styrene-acryl resin, an epoxy resin and an ethylene-norbornene resin. Of these, the polyester resin is particularly preferable.

The softening point of the binder resin should preferably be 110° C. to 145° C., and more preferably, 115° C. to 145° C. If it is less than 110° C., there is a tendency that the grittiness becomes even worse, whereas if it exceeds 145° C., there is a tendency that the fixing temperature is increased, and therefore the low-temperature fixing becomes difficult.

A fluorine-containing resin can be applied on the rubber layer. Examples of the fluorine-containing resin used here are an ethylene tetrafluoride/propylene hexafluoride copolymer and polytetrafluoroethylene.

The thickness of the fluorine-containing resin coating layer should preferably be 10 to 100 μm. If it exceeds 100 μm, the surface of the roller becomes excessively hard, and therefore there is a tendency that grittiness is created. On the other hand, if it is less than 100 μm, there is a tendency that the manufacturing of the layer becomes difficult.

Examples of the wax usable in this invention are rice wax, carnauba wax, synthetic ester wax, polypropylene wax and polyethylene wax.

The content of the wax with respect to the binder resin should preferably be 0.5 to 25% by weight, and more preferably, 2 to 15% by weight. If it is less than 0.5% by weight, there is a tendency that a sufficient mold release effect cannot be obtained. On the other hand, if it exceeds 30% by weight, there is a tendency that the preservability is deteriorated, and the photoreceptor, the charging member and the like are contaminated with the toner.

The JIS A rubber hardness is a value corresponding to that of type A of the hardness test with a durometer by ISO 7619.

It can be noted that when a yellow coloring agent is employed, the crushing of dots, grittiness of the surface of the image and the like are less prominent as compared to the cases of the other coloring agent. Therefore, the rubber hardness may be set to 30 to 10°, the thickness of the rubber layer may be set to 0.1° to 1.0°, preferably, 0.2° to 0.8°, and the softening point of the binder may be set to 100 to 145° C., preferably 105° to 145°.

Further, it is preferable that the heat fixing roller can be coated with a fluorine-containing resin such as PFA resin, and more preferably, the press roller can be coated as well. In this manner, a long life of each of these rollers can be achieved, due to the high anti-abrasion property. Thus, when the heat fixing roller coated with the fluorine-containing resin, the press roller preferably coated with the fluorine-containing resin, and the wax-containing toner are used in combination, a sufficient non-offset property could be obtained. Thus, the addition of the wax along with the use of the roller coated with the fluorine-containing resin makes it unnecessary to provide a member for supply oil to the surface of the fixing roller. Therefore, the formation of images can be carried out at a lower cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent that is used in combination with a fixing device comprising a thermal fixing roller including a metal roller, a rubber layer provided on a surface of the metal roller and having a rubber hardness defined by JIS A of 3° or more and less than 5°, and a press roller provided to face the thermal fixing roller, wherein the developing agent contains a coloring agent and a binder resin, a softening point of the binder resin and a thickness of the rubber layer satisfying a relationship represented by the following formula:

$$y \geqq 10^{-6}x^4-0.0007x^3+0.1217x^2-9.9932x+314.31 \quad (1)$$

where y: the thickness of the rubber layer (mm), and x: the softening point (° C.) of the binder resin.

2. The developing agent according to claim 1, wherein the thickness of the rubber layer is 0.1 to 1.0 mm.

3. The developing agent according to claim 2, wherein the thickness of the rubber layer is 0.1 to 0.5 mm.

4. The developing agent according to claim 1, wherein the softening point of the binder resin is 110 to 145°.

5. The developing agent according to claim 1, wherein the coloring agent is of a yellow color.

6. A developing agent that is used in combination with a fixing device comprising a thermal fixing roller including a metal roller, a rubber layer provided on a surface of the metal roller and having a rubber hardness defined by JIS A of 3° or more and less than 8°, and a press roller provided to face the thermal fixing roller, wherein the developing agent contains a coloring agent and a binder resin, a softening point of the binder resin and a thickness of the rubber layer satisfying a relationship represented by the following formula:

$$y \geqq 10^{-6}x^4-0.0004x^3+0.0774x^2-6.2789x+200.34 \quad (2)$$

where y: the thickness of the rubber layer (mm), and x: the softening point (° C.) of the binder resin.

7. The developing agent according to claim 7, wherein the thickness of the rubber layer is 0.1 to 1.0 mm.

8. The developing agent according to claim 7, wherein the thickness of the rubber layer is 0.1 to 0.5 mm.

9. The developing agent according to claim 6, wherein the softening point of the binder resin is 110 to 145° C.

10. A method of fixing a developing agent used in combination with a fixing device comprising:

a thermal fixing roller including a metal roller, a rubber layer provided on a surface of the metal roller and a resin coating layer provided on the rubber layer; and a press roller provided to face the thermal fixing roller, wherein a softening point of a binder resin and a thickness of the rubber layer satisfies a relationship represented by the following formula (1) or (2):

when a rubber hardness defined by JIS A is 3° or more and less than 5°, $$y \geqq 10^{-6}x^4-0.0007x^3+0.1217x^2-9.9932x+314.31 \quad (1)\text{or}$$

when a rubber hardness defined by JIS A is 5° to 8°, $$y \geqq 10^{-6}x^4-0.0004x^3+0.0774x^2-6.2789x+200.34 \quad (2)$$

where y: the thickness of the rubber layer (mm), and x: the softening point (0°C.) of the binder resin.

11. The fixing method according to claim 10, wherein the thickness of the rubber layer is 0.1 to 1.0 mm.

12. The fixing method according to claim 11, wherein the thickness of the rubber layer is 0.1 to 0.5 mm.

13. The fixing method according to claim 10, wherein the softening point of the binder resin is 110 to 145° C.

14. The fixing method according to claim 10, wherein the thickness of the rubber layer is 0.1 to 0.5 mm and the softening point of the binder resin is 125 to 135° C.

15. The fixing method according to claim 10, wherein the coloring agent is of a yellow color.

* * * * *